US006842085B2

(12) United States Patent
Chen et al.

(10) Patent No.: US 6,842,085 B2
(45) Date of Patent: Jan. 11, 2005

(54) ORTHOMODE TRANSDUCER HAVING IMPROVED CROSS-POLARIZATION SUPPRESSION AND METHOD OF MANUFACTURE

(75) Inventors: Ming H. Chen, Rancho Palos Verdes, CA (US); Chin-Yi Chu, Hsi Chih (TW)

(73) Assignee: Victory Microwave Corporation, Hsi Chih City (TW)

( * ) Notice: Subject to any disclaimer, the term of this patent is extended or adjusted under 35 U.S.C. 154(b) by 113 days.

(21) Appl. No.: 10/248,777

(22) Filed: Feb. 18, 2003

(65) Prior Publication Data

US 2004/0160292 A1 Aug. 19, 2004

(51) Int. Cl.[7] ..... H01P 5/12

(52) U.S. Cl. ..... 333/125; 333/21 A; 333/122; 333/135

(58) Field of Search ..... 333/21 A, 122, 333/125, 126, 135, 100, 127, 136

(56) References Cited

U.S. PATENT DOCUMENTS

| | | | | | |
|---|---|---|---|---|---|
| 3,201,717 | A | * | 8/1965 | Billon et al. | 333/125 |
| 3,284,725 | A | * | 11/1966 | Bowman | 333/125 |
| 3,958,193 | A | * | 5/1976 | Rootsey | 333/125 |
| 5,392,008 | A | | 2/1995 | Wong | 333/21 |
| 5,398,035 | A | * | 3/1995 | Densmore et al. | 343/713 |
| 6,087,908 | A | * | 7/2000 | Haller et al. | 333/122 |
| 6,225,875 | B1 | * | 5/2001 | Kich | 333/125 |
| 6,473,053 | B1 | | 10/2002 | Krishmar-Junker et al. | 343/772 |
| 6,661,390 | B2 | * | 12/2003 | Gau et al. | 343/786 |
| 2002/0175875 | A1 | | 11/2002 | Verstaeten | 343/786 |

* cited by examiner

*Primary Examiner*—Robert Pascal
*Assistant Examiner*—Kimberly Glenn
(74) *Attorney, Agent, or Firm*—Clifford B. Perry

(57) ABSTRACT

An orthomode transducer includes a first waveguide section, a second waveguide section coupled to the first waveguide section, and a third waveguide section coupled to the first and second waveguide sections. The first waveguide section is configured to support the propagation of a signal having a first polarization, and includes a first waveguide aperture sized to communicate the signal having the first polarization therethrough. The second waveguide is configured to support the propagation of a signal having a second polarization which is orthogonal to the first polarization, the second waveguide section having a single internal septum and a second waveguide aperture sized to communicate the signal having the second polarization therethrough. The third waveguide is configured to support the propagation of either a signal having the first polarization or the second polarization, and includes a third waveguide aperture sized to communicate the signals having either the first or second polarization therethrough.

20 Claims, 7 Drawing Sheets

ORTHOMODE TRANSDUCER HAVING IMPROVED CROSS-POLARIZATION SUPPRESSION AND METHOD OF MANUFACTURE

BACKGROUND OF INVENTION

The present invention relates generally to transducers, and more particularly to orthomode transducers and their method of manufacture.

As known in the art of front-end electronics, the orthomode transducer (OMT) is a three-port device which can be used to separate and/or combine orthogonally polarized signals. In a conventional use, the OMT is used to receive signals of a first polarization, and transmit signals of an orthogonal polarization using the same antenna.

FIG. 1 illustrates a perspective view of a conventional Ku-band OMT 100 known in the art. As shown, the OMT includes a transmit section 110, a receive section 130, and an antenna section 150. The transmit section 110 is configured to transmit a vertically-polarized signal 125 (typically in the range from 14–14.5 GHz for Ku band operation) and includes a transmit port 112 containing a substantially rectangular aperture 114. The transmit section 110 may further include an internal septum 116 for improving the impedance match between the transmitter circuitry and the antenna (neither shown).

The receive section 130 is configured to receive a horizontally-polarized signal 135 (typically in the range from 10.95–12.75 GHz for Ku band operation) and includes a receive port 132 containing a substantially rectangular aperture 134. The antenna section 150 includes an antenna port 152 containing a circular aperture 154 which is sized to support the transmission of the outgoing vertically-polarized signal 125, or the reception of the incoming horizontally-polarized signal 135, thereby operating over the combined transmit/receive band of 10.95–14.5 GHz. The wideband OMT permits the use of a single antenna for transmission and reception, which greatly reduces the system's cost.

Unfortunately, wideband OMTs, such as the exemplary 10.95–14.5 GHz OMT, face a common obstacle in that the dimensions of the antenna section 150 usually permit the propagation of higher, deleterious waveguide modes. In particular, if the cutoff frequency for the antenna section 150 is designed at 10 GHz, a higher order $TM_{01}$ waveguide mode will exist at approximately 13.05 GHz, occurring in the upper band of the OMT's operation. The existence of this mode means that signals within the antenna section 150 above 13.05 GHz may propagate in either the dominant mode $TE_{11}$, in the higher mode $TM_{01}$, or possibly both. Signal propagation in the dominant $TE_{11}$ mode is desired as it produces the intended vertically-polarized signal. Signal propagation in the $TM_{01}$ mode is undesirable, as it will propagate as a cross-polarized signal, e.g., a horizontally-polarized signal in the present example. As a result of this, the intended vertically-polarized signal will have reduced signal strength. Moreover, the signal may experience mode conversion in which it switches between the $TE_{11}$ and $TM_{01}$ signal modes, resulting in significant signal distortion.

FIG. 2 illustrates a H-plane response of the conventional Ku-band OMT shown in FIG. 1. Trace 210 shows the amplitude of the desired co-polarization signal, and trace 230 shows the undesired cross-polarization signal. The amplitude of the transmitted cross-polarization signal 230 rises to 23 dB relative to the co-polarization signal 210.

The presence of the undesired cross-polarization signal 230 indicates the corresponding presence of TM01 mode signals propagating in the antenna section 150 which, as explained above, depletes power from the desired transmitted signal and contributes to significant signal distortion. What is therefore needed is an OMT having improved cross-polarization suppression.

SUMMARY OF INVENTION

The present invention provides an orthomode transducer having improved cross-polarization suppression. In a particular embodiment the OMT includes a first waveguide section, a second waveguide section coupled to the first waveguide section, and a third waveguide section coupled to the first and second waveguide sections. The first waveguide section is configured to support the propagation of a signal having a first polarization, and includes a first waveguide aperture sized to communicate the signal having the first polarization therethrough. The second waveguide is configured to support the propagation of a signal having a second polarization which is orthogonal to the first polarization, the second waveguide section having a single internal septum and a second waveguide aperture sized to communicate the signal having the second polarization therethrough. The third waveguide is configured to support the propagation of either a signal having the first polarization or the second polarization, and includes a third waveguide aperture sized to communicate the signals having either the first or second polarization therethrough.

Other embodiments of the invention, as well as particular features of the embodiments will be more readily understood in view of the following drawings and detailed description.

DETAILED DESCRIPTION

Figure 1:
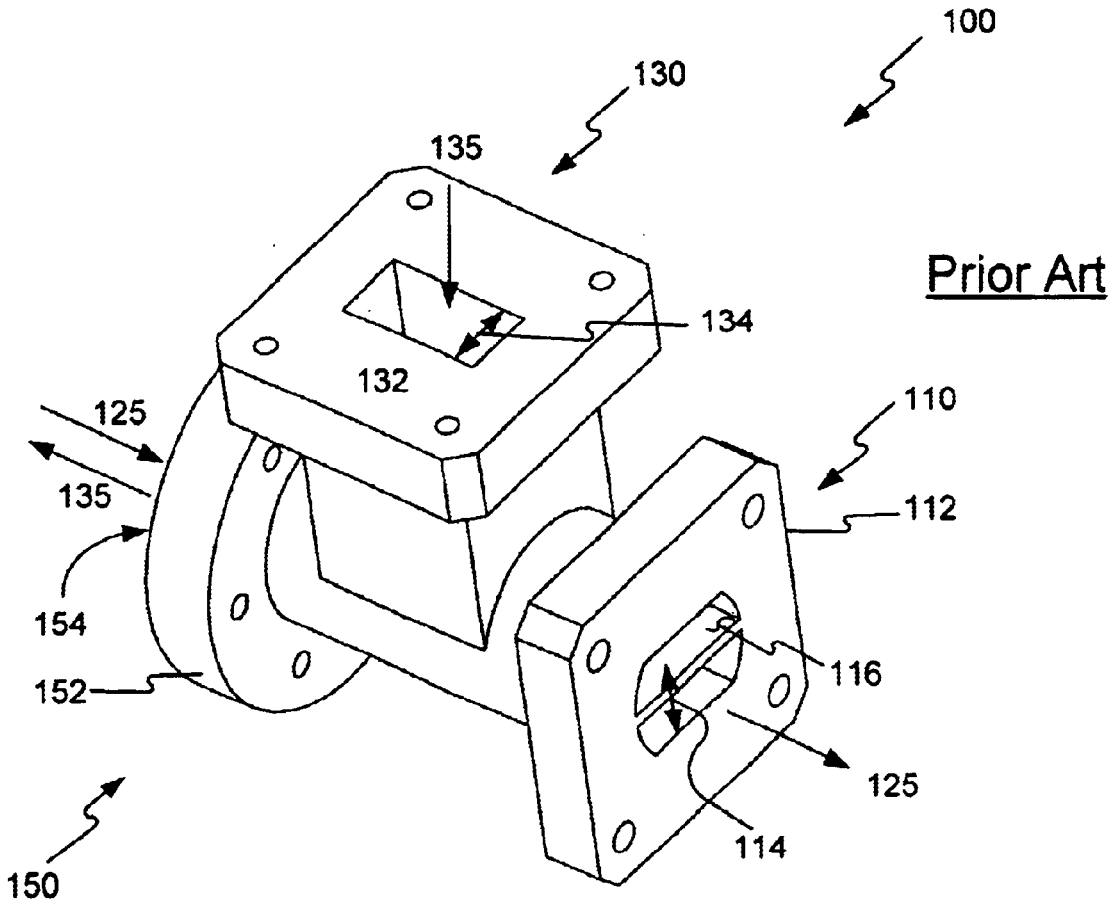
FIG. 1 illustrates a perspective view of a conventional orthomode transducer known in the art.
Figure 2:
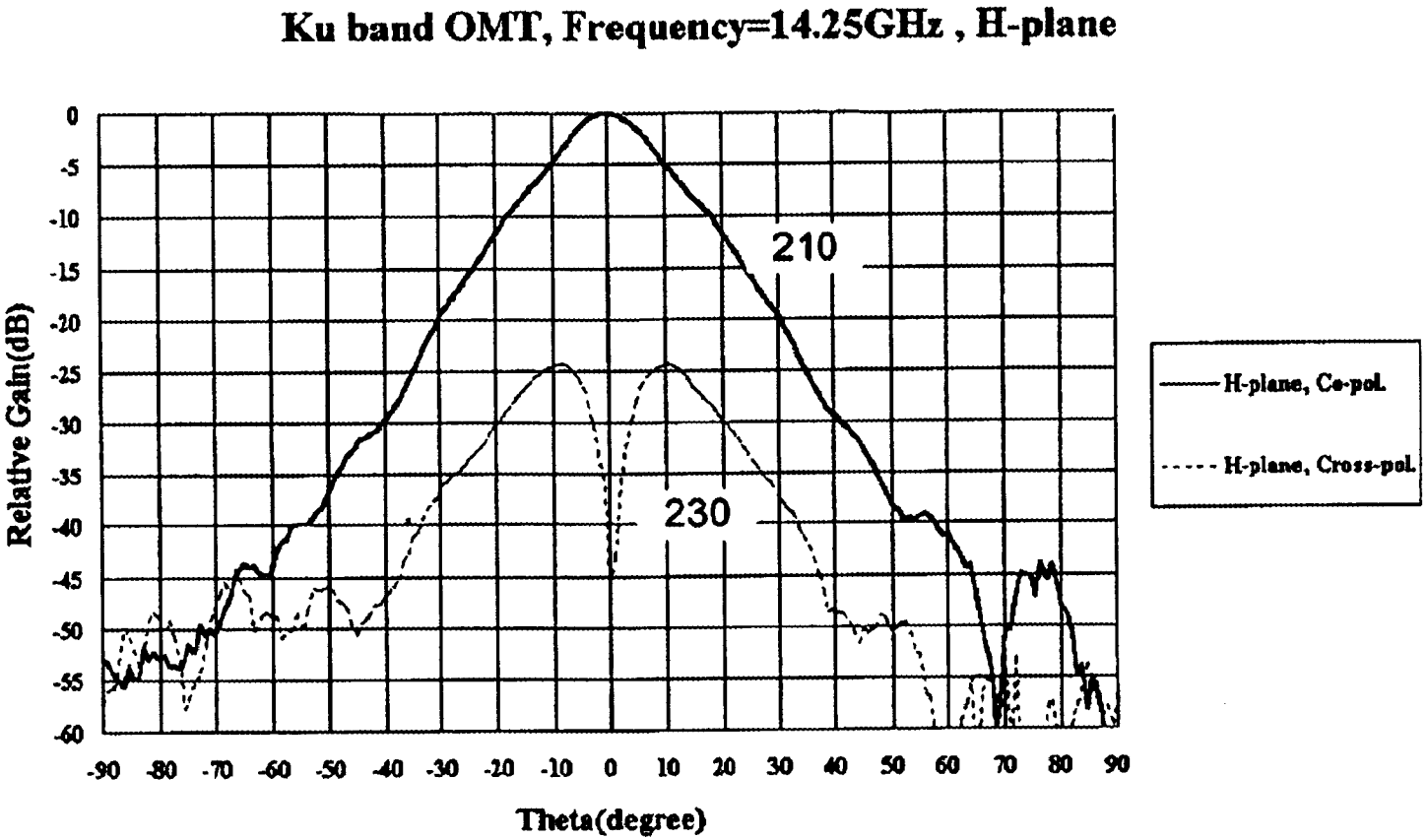
FIG. 2 illustrates the H-plane response of a conventional orthomode transducer shown in FIG. 1.
Figure 3A:
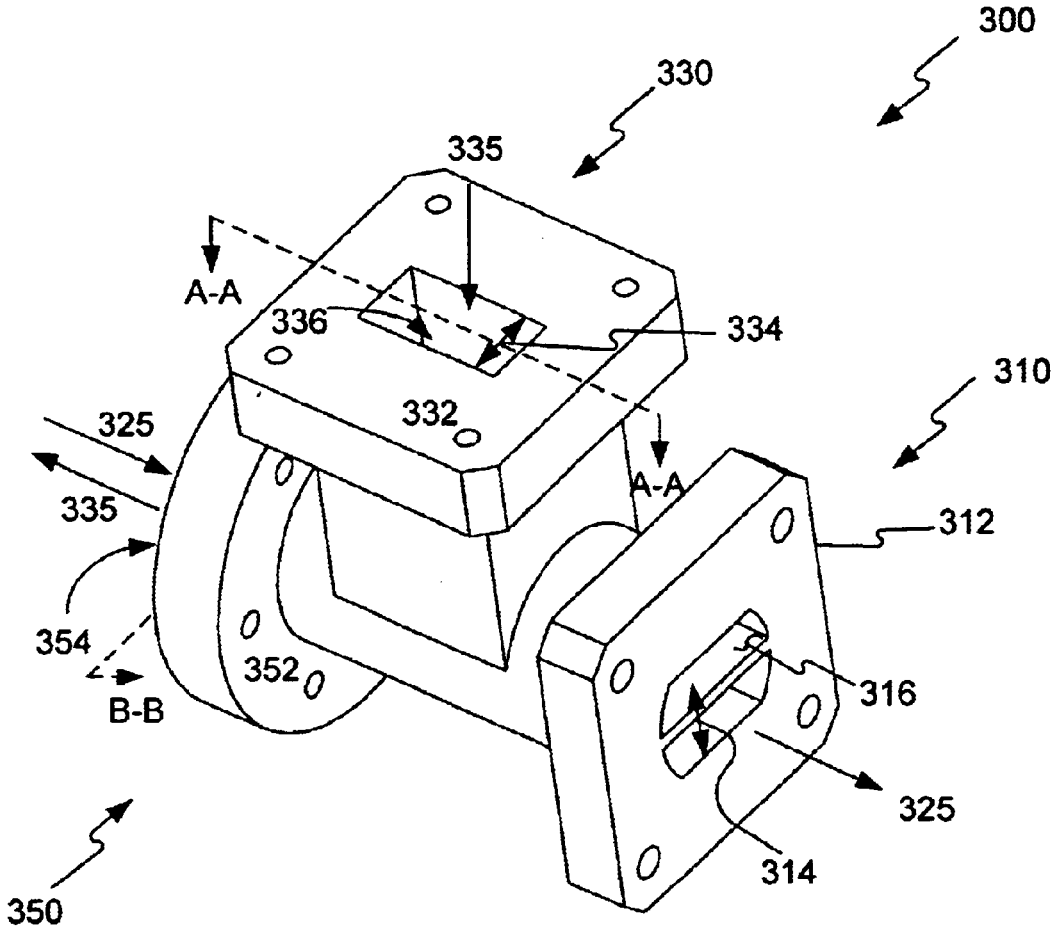
FIG. 3A illustrates a perspective view of an orthomode transducer having improved cross-polarization suppression in accordance with one embodiment of the present invention.

FIG. 3A illustrates a perspective view of an OMT having improved cross-polarization suppression in accordance with one embodiment of the present invention. The OMT includes a first (transmit) waveguide section 310, a second (receive) waveguide section 330, and a third (antenna) waveguide section 350. In the exemplary embodiment, the transmit waveguide section 310 is configured to support the transmission of a vertically-polarized Ku-band signal 325, and includes a transmit port 312 containing an aperture 314 sized to transmit the vertically-polarized signal between 14.0–14.5 GHz. The transmit waveguide section 310 further includes an internal septum 316 used to provide improved impedance matching between interconnecting components. Further, the internal septum 316 may be have a varying thickness dimensions to improve impedance matching further and to facilitate cast manufacturing of the OMT, the process of which is further described below.

The OMT 300 further includes a second (receive) waveguide section 330 configured to support a signal having a second polarization which is orthogonal to the first polarization, that signal being a received horizontally-polarized Ku-band signal 335 in the exemplary embodiment. The receive waveguide section 330 includes a receive port 332 containing an aperture 334 which is sized appropriately to receive a 10.95–12.75 GHz horizontally-polarized signal 335 therethrough. In the exemplary embodiment, the aperture 334 may be a WR75 aperture. The receive waveguide section 330 further includes a single internal septum 336 (illustrated in FIG. 3C below) operable to provide improved cross-polarization suppression. In a particular embodiment, the internal septum 336 may having a varying thickness dimension to facilitate cast fabrication of the OMT 300 as will be further discussed below.

The OMT 300 further includes a third (antenna) waveguide section 350 which is configured to support the vertically-polarized transmitted signal 325 or the horizontally-polarized signal 335. The antenna waveguide section 350 includes an antenna port 352 containing a circular (or alternatively, square) aperture sized appropriately to support the propagation of the vertically-polarized transmit signal 325 or the horizontally-polarized receive signal 335.

Figure 3B:
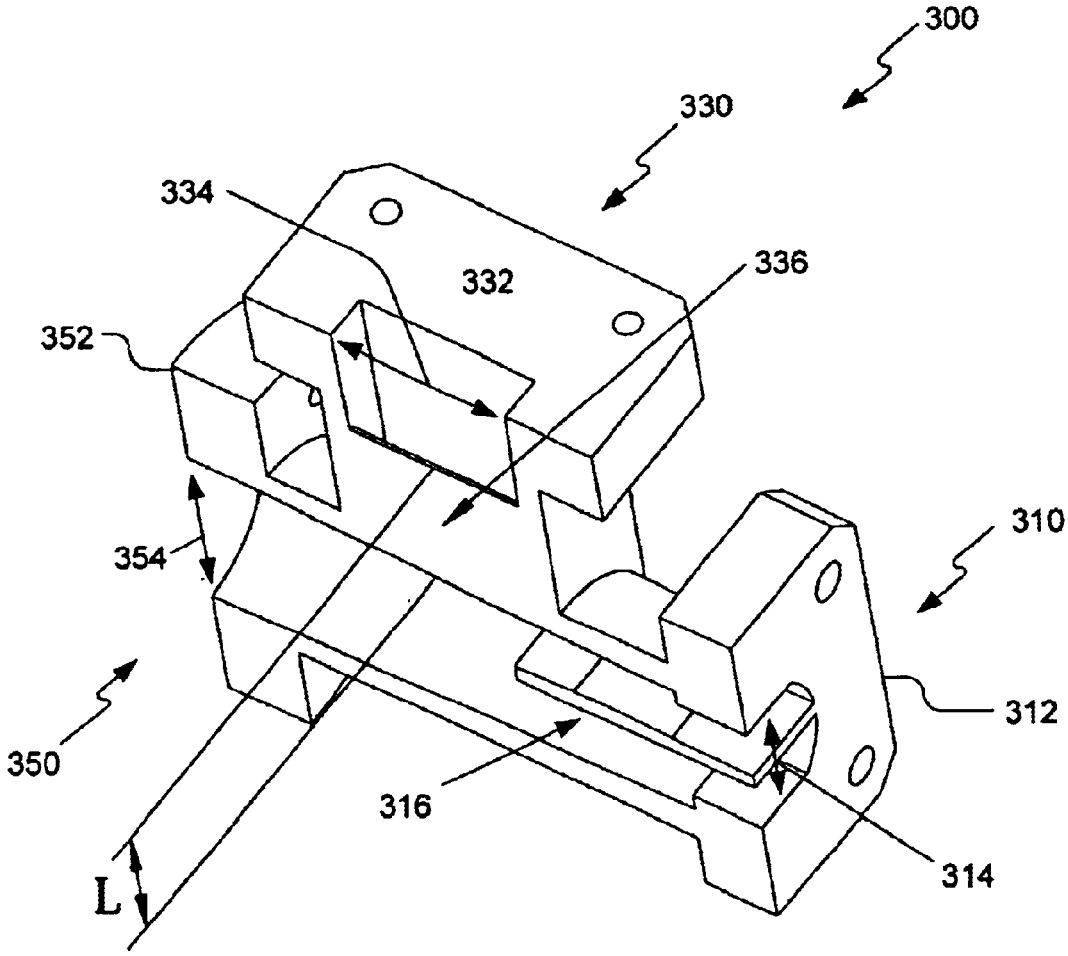
FIG. 3B illustrates a cut-away perspective view of the orthomode transducer shown in FIG. 3A in accordance with the present invention

FIG. 3B illustrates a section view A—A of the orthomode transducer shown in FIG. 3A in accordance with the present invention, with previously identified components retaining their original reference numerals. As can be seen, internal septum 336 extends a length L, which is only partially the length of receive waveguide section 330.

Further observable is that the internal septum 316 may having a varying thickness dimension to facilitate cast fabrication of the OMT 300 as will be further discussed below.

Figure 3C:
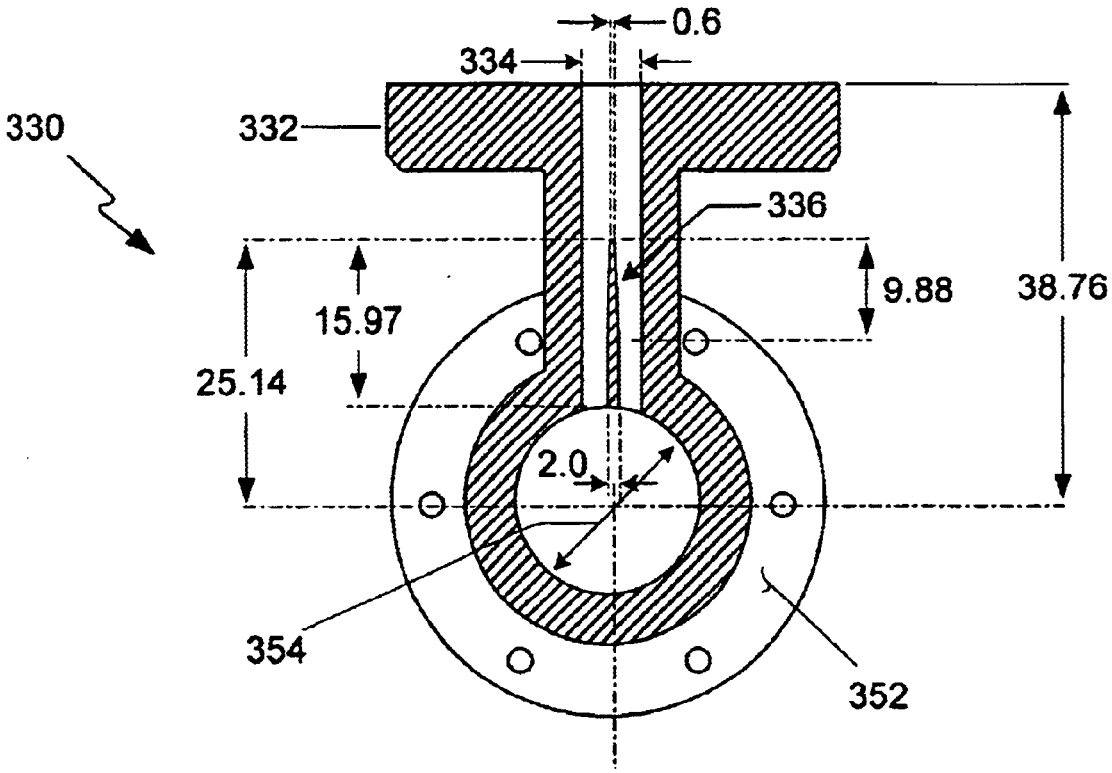
FIG. 3C illustrates a section view of the orthomode transducer shown in FIG. 3A in accordance with the present invention.

FIG. 3C illustrates a section view B—B of the orthomode transducer shown in FIG. 3A in accordance with the present invention, with previously identified components retaining their reference numerals. As shown, the internal septum 336 has a length L of approximately 16 mm (0.63"). The internal septum 336 also has a varying thickness dimension, consisting of a 2 mm (0.078") thickness for approximately 6 mm, and tapering down to 0.6 mm (0.023") over approximately 10 mm (0.394"). The septum 336 is not limited to the dimensions illustrated, and septums of other lengths as well as shapes and tapers in which the septum increases or decreases in thickness may be used in alternative embodiments of the present invention. Further alternatively, the internal septum 336 will comprise a constant thickness over its entire length.

Figure 4:
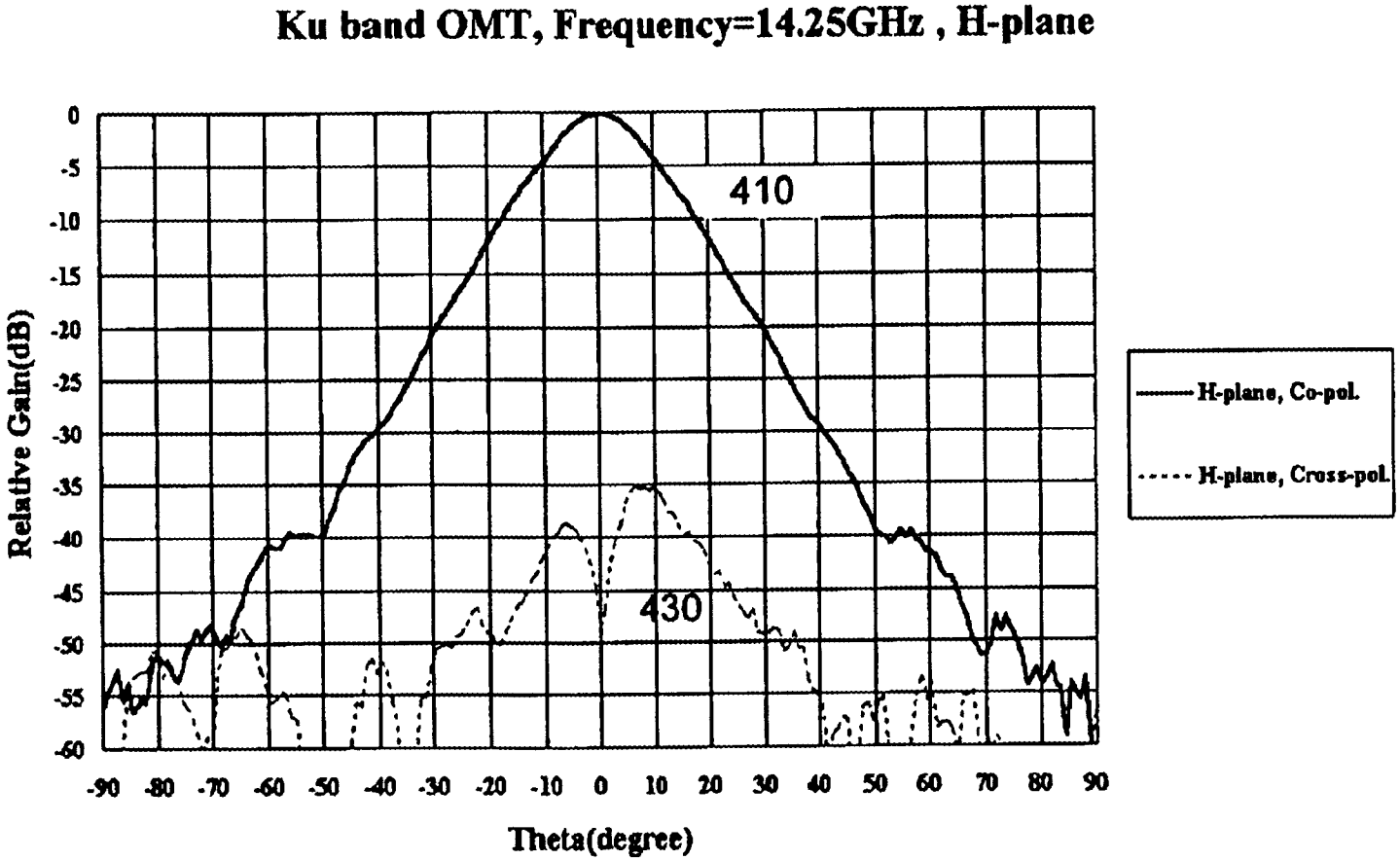
FIG. 4 illustrates the H-plane response of the improved orthomode transducer shown in FIG. 3A in accordance with the present invention.

FIG. 4 illustrates the H-plane response of the improved orthomode transducer shown in FIG. 3A in accordance with the present invention. Trace 410 shows the amplitude of the desired co-polarized signal and trace 430 shows the amplitude of the undesired cross-polarized. Compared to the conventional OMT, the amplitude of the cross-polarization signal in the new OMT is reduced by 13 dB (or a factor 20) from 23 in the conventional OMT to 35 dB in the new OMT. As explained above, lower cross-polarization signal transmission translates to less signal loss and lower signal distortion in the desired transmitted signal, and consequently, improved system performance.

The OMT 300 of the present invention may be manufactured from a variety of materials used in the construction of waveguide components. Such materials include aluminum, copper, brass, and Kovar, and other materials (possibly plated) which are commonly used in the microwave frequency component manufacture. Techniques for manufacturing the OMT of the present invention would include the conventional processes of precision machining the OMT (usually by a numerically controlled machine) to the desired dimensions. High frequency components often require precision machining due to the very tight tolerances needed for high frequency operation. However, precision machining is expensive and an alternative technique is to cast the structure. Casting represents a substantially lower cost method of manufacturing since once a final mold is made, each part may be fabricated quickly and inexpensively in contrast to the time, skilled labor and machinery need to machine each part.

Casting, however, requires tapering portions of the structure to allow placement and removal of molds with the structure. However, high frequency structures such as the OMT of the present invention are generally designed assuming substantially straight edges and corners. Consequently, the introduction of tapered edges and corners will alter the performance of the structure, usually resulting in degraded performance.

Figure 5:
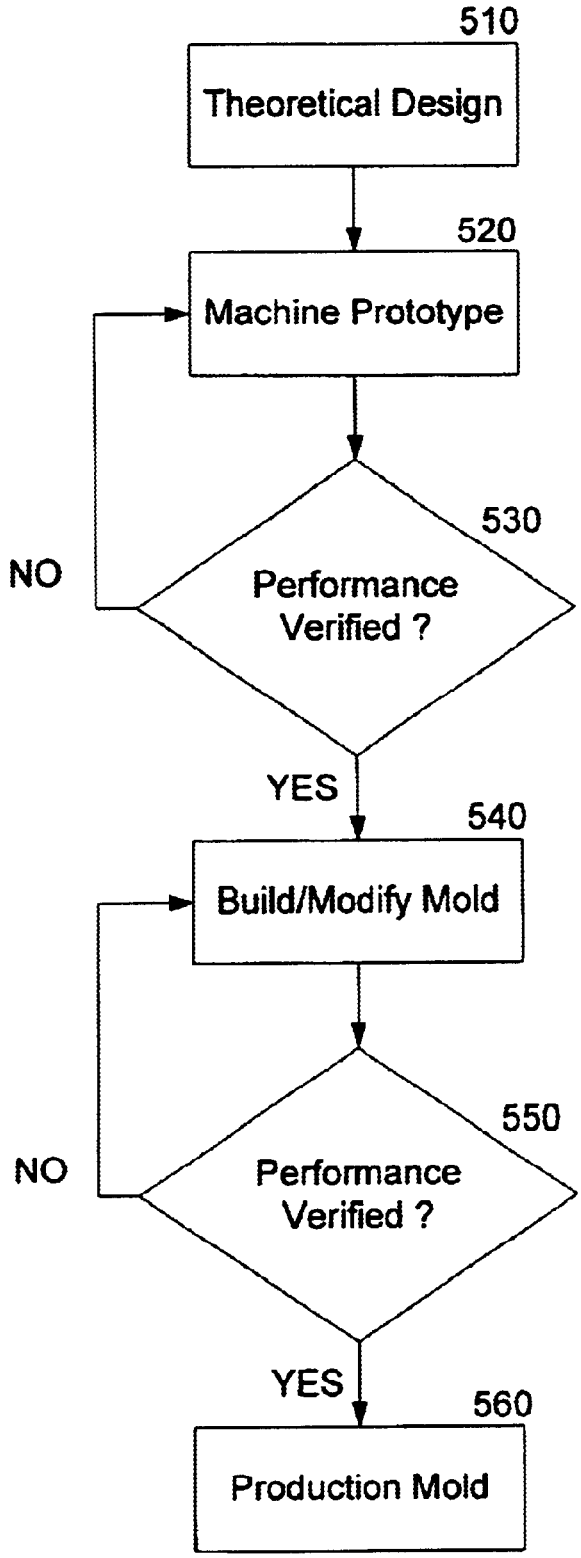
FIG. 5 illustrates a method of manufacturing the orthomode transducer of the present invention by using casting techniques.

FIG. 5 illustrates a method of manufacturing the orthomode transducer of the present invention by using casting techniques. Initially at process 510, a theoretical design of the OMT is developed using conventionally known techniques (e.g., three dimensional circuit simulation tools such as HFSS available from Agilent Technologies of Palo Alto, Calif.). Once the theoretical design is finalized, a prototype is precision machined (process 520) using conventionally known techniques such a numerically controlled machining.

Once machined, the measured performance of the prototype is compared with the simulated performance (process 530). In one embodiment, the process is performed by comparing the measured and simulated cross-polarization responses of the OMT. If the measured performance is within an acceptance window relative to the desired performance, a casting mold of the OMT is made (process 540). The casting mold is substantially similar to the engineering drawings of the machined structure, the exception being that the internal walls and septum thickness are tapered to allow placement and removal of the casting mold.

Subsequently, the cast OMT is formed and its performance measured (process 550). If the measured performance is within a predefined window of the desired performance, the casting mold becomes the production mold from which additional OMTs are manufactured (process 560). In a particular embodiment of 500, process 560 comprises manufacturing the cast OMTs in aluminum.

If the measured response of the OMT is not within a predefined range of the desired response, processes 540 and 550 are repeated in which casting molds are modified and the OMT re-cast. In a particular embodiment of this process, if the measured cross-polarization response of the cast OMT is not within a predefined range of the desired cross-polarization response, processes 540 and 550 are repeated. Process 500 continues in this manner until the measured performance of the cast OMT is within the acceptable range of the desired performance. The resulting molds are then used as the production molds to fabricate the number of OMTs required.

While the above is a detailed description of the present invention, it is only exemplary and various modifications, alterations and equivalents may be employed in various apparati and processes described herein. For example, the waveguide and aperture dimensions may be changed to permit operation at different frequencies as known in the art. Accordingly, the scope of the present invention is hereby defined by the metes and bounds of the following claims:

What is claimed is:

1. An orthomode transducer, comprising:

a first waveguide section configured to support the propagation of a signal having a first polarization, the first waveguide section comprising a first waveguide aperture sized to communicate the signal having the first polarization therethrough;

a second waveguide section coupled to the first waveguide section and configured to support the propagation of a signal having a second polarization which is substantially orthogonal to the first polarization, the second waveguide section comprising a single internal septum and a second waveguide aperture sized to communicate the signal having the second polarization therethrough; and a third waveguide section coupled to the first waveguide section and the second waveguide section, and configured to support the propagation of a signal having the first polarization or the second polarization, the third waveguide section comprising a third waveguide aperture sized to communicate the signal having the first signal polarization or the second polarization therethrough.

2. The orthomode transducer of claim 1, wherein:

the first waveguide section comprises a substantially rectangular waveguide operable to support the propagation of a vertically-polarized signal;

the second waveguide section comprises a substantially rectangular waveguide operable to support the propagation of a horizontally-polarized signal; and the third waveguide section comprises a substantially circular or square waveguide operable to support the propagation of either the vertically-polarized signal or the horizontally-polarized signal.

3. The orthomode transducer of claim 1, wherein the single internal septum of the second waveguide section has a vary thickness dimension.

4. The orthomode transducer of claim 1, wherein the single internal septum of the second waveguide section has a substantially constant thickness dimension.

5. The orthomode transducer of claim 1, wherein the single internal septum of the second waveguide section comprises a length less than the length of the second waveguide section.

6. The orthomode transducer of claim 1, wherein the dimensions of the first waveguide section and first waveguide aperture are sized to support the propagation of a signal within the band of 14–14.5 GHz.

7. The orthomode transducer of claim 1, wherein the dimensions of the second waveguide section and second waveguide aperture are sized to support the propagation of a signal within the band of 10.95–12.75 GHz.

8. The orthomode transducer of claim 1, wherein the first, second, and third waveguide sections are integrally formed in cast aluminum.

9. The orthomode transducer of claim 1, wherein the first, second, and third waveguide sections are integrally formed in machined aluminum, brass, copper, or Kovar.

10. An orthomode transducer, comprising:

a transmit waveguide section configured to transmit a vertically-polarized signal, the transmit waveguide section comprising an aperture sized to transmit the vertically polarized signal therethrough;

a receive waveguide section coupled to the receive waveguide section and configured to receive a horizontally-polarized signal, the receive waveguide section comprising a single internal septum and a substantially rectangular aperture sized to receive the horizontally-polarized signal therethrough; and an antenna waveguide section coupled to the transmit waveguide section and the receive waveguide section, the antenna waveguide section configured to support the propagation of the transmitted vertically-polarized signal and the received horizontally-polarized signal, the antenna waveguide section comprising a substantially circular aperture sized to communicate the vertically-polarized signal and the horizontally-polarized signal therethrough.

11. The orthomode transducer of claim 10, wherein the single internal septum of the receive waveguide section has a vary thickness dimension.

12. The orthomode transducer of claim 10, wherein the single internal septum of the receive waveguide section has a substantially constant thickness dimension.

13. The orthomode transducer of claim 10, wherein the single internal septum of the receive waveguide section comprises a length less than the length of the receive waveguide section.

14. The orthomode transducer of claim 10, wherein the dimensions of the transmit waveguide section and the transmit waveguide aperture are sized to support the transmission of a signal within the band of 14–14.5 GHz.

15. The orthomode transducer of claim 10, wherein the dimensions of the receive waveguide section and receive waveguide aperture are sized to support the reception of a signal within the band of 10.95–12.75 GHz 16. The orthomode transducer of claim 10, wherein the receive, transmit, and antenna waveguide sections are integrally formed in cast aluminum.

17. The orthomode transducer of claim 10, wherein the receive, transmit, and antenna waveguide sections are integrally formed in machined aluminum, brass, copper, or Kovar.

18. A method for fabricating a orthomode transducer, the method comprising:

developing a theoretical design of the orthomode transducer having a desired cross-polarization response;

fabricating a machined orthomode transducer prototype based upon the developed theoretical design;

verifying the performance of the machined orthomode transducer prototype;

generating a casting negative based upon the machined orthomode transducer prototype;

fabricating a cast orthomode transducer prototype;

verifying the performance of the cast orthomode transducer prototype;

providing a production cast negative for the orthomode transducers; and casting, using the production cast negative, one or more orthomode transducers.

19. The method of claim 18, wherein verifying the performance of the machined orthomode transducer prototype comprises:

measuring the cross-polarization response of the machined orthomode transducer prototype; and if the measured cross-polarization response is not within a predefined range of the desired cross-polarization response, repeating the steps of developing a theoretical design, and fabricating a machined orthomode transducer prototype.

20. The method of claim 18, wherein casting one or more orthomode transducers comprises casting one or more orthomode transducers in aluminum.

* * * * *